United States Patent [19]

Sullivan

[11] 4,153,252

[45] May 8, 1979

[54] AERODYNAMIC DISC

[76] Inventor: Richard A. Sullivan, P.O. Box 6, East Rutherford, N.J. 07073

[21] Appl. No.: 847,072

[22] Filed: Oct. 31, 1977

[51] Int. Cl.[2] ..... A63H 33/18

[52] U.S. Cl. ..... 273/106 B; 46/74 D

[58] Field of Search ..... 46/74 D; 273/106 B

[56] References Cited

U.S. PATENT DOCUMENTS

| | | | |
|---|---|---|---|
| 960,715 | 6/1910 | Schneider | 46/241 |
| 3,359,678 | 12/1967 | Headrick | 46/74 D |
| 3,673,731 | 7/1972 | Farhi et al. | 46/74 D |
| 3,724,122 | 4/1973 | Gillespie | 46/74 D |
| 3,852,910 | 12/1974 | Everett | 46/74 D |
| 3,948,523 | 4/1976 | Michael | 273/106 B |

*Primary Examiner*—Louis G. Mancene
*Assistant Examiner*—Robert F. Cutting
*Attorney, Agent, or Firm*—Mel K. Silverman

[57] ABSTRACT

An aerodynamic disc-shaped object is provided, comprising a disc, an outer toroidal rim section attached to the periphery of the disc, and a central section disposed within the center of the disc, wherein the central section comprises a substantial amount of the weight of the disc-shaped object for increasing the rotational spin of the object.

7 Claims, 3 Drawing Figures

AERODYNAMIC DISC

BACKGROUND OF THE INVENTION

This invention relates to an aerodynamic, disc-shaped object. More particularly, this invention relates to an aerodynamic disc-shaped object having utility as a projectile used in amusements, such as games of catch and the like.

It is well known in the prior art to provide a disc-shaped object having an outer rim secton for utilization as an aerodynamic toy. Typical examples of such discs are found in U.S. Pat. Nos. 3,359,678 and 3,724,122. However, these latter patents do not disclose the strategic displacement of weight throughout the disc-shaped object.

Moreover, all of the patents that utilize the displacement of weights on an aerodynamic disc for trajectory purposes, employ this weight addition or displacement toward the periphery of the disc. For example, U.S. Pat. No. 3,673,731 discloses an aerodynamic disc and gyroscopic toy in which the disc preferably has its rim thickened to concentrate a large portion of the mass of the toy as far from the axis of rotation as is possible. Also, U.S. Pat. No. 3,828,466 discloses a flying saucer utilizing a rim which is thicker and has more weight thereon for stabilizing the flying saucer. U.S. Pat. No. 3,852,910 also discloses an aerial toy disc having airfoils thereon, wherein adjustable weights are attached to the peripheral ends of the airfoils to allow the user to change the lift to weight ratio. See also U.S. Pat. No. 4,023,805 in which the rim of a flying disc toy is eccentrically weighted.

The only U.S. patent that disclosed an aerodynamic toy of a generally flat circular configuration, wherein the foam density in the center was slightly greater than at the peripheral regions, in U.S. Pat. No. 3,710,505. However, the central region in this latter patent is substantially large so as to encompass most of the aerodynamic toy. Additionally, the higher density in the central region only acts to retain the toy in a permanent convex configuration and not to increase the rotational spin of the toy.

Accordingly, it is believed that the present invention solves the problem in the prior art of providing an aerodynamic disc-shaped object having increased rotational spin.

SUMMARY OF THE INVENTION

In accordance with the present invention, an aerodynamic disc-shaped object is provided, comprising a disc, an outer toroidal rim section attached to the periphery of the disc, and a central section disposed within the center of the disc, wherein the central section comprises a substantial amount of the weight of the disc-shaped object for increasing the rotational spin of the object. The central section is also preferably of a magnetic material.

Accordingly, it is a principal object of the present invention to provide an aerodynamic disc-shaped object in which a substantial amount of the weight of the disc-shaped object is disposed at the center of the object for increasing the rotational spin of the object.

It is a further object of the present invention to provide an aerodynamic disc-shaped object in which the distance and accuracy of the desired trajectory, are increased.

It is a still further object of the present invention to provide an aerodynamic disc-shaped object in which a substantial amount of the weight of the disc-shaped object is disposed within a central axis of the object.

It is a yet further object of the present invention to provide an aerodynamic disc-shaped object which is inexpensive and easy to manufacture.

Further objects and advantages will become apparent to those skilled in the art from the ensuing description which proceeds with reference to the accompanying figures.

DESCRIPTION OF THE PREFERRED EMBODIMENTS

Figure 1:
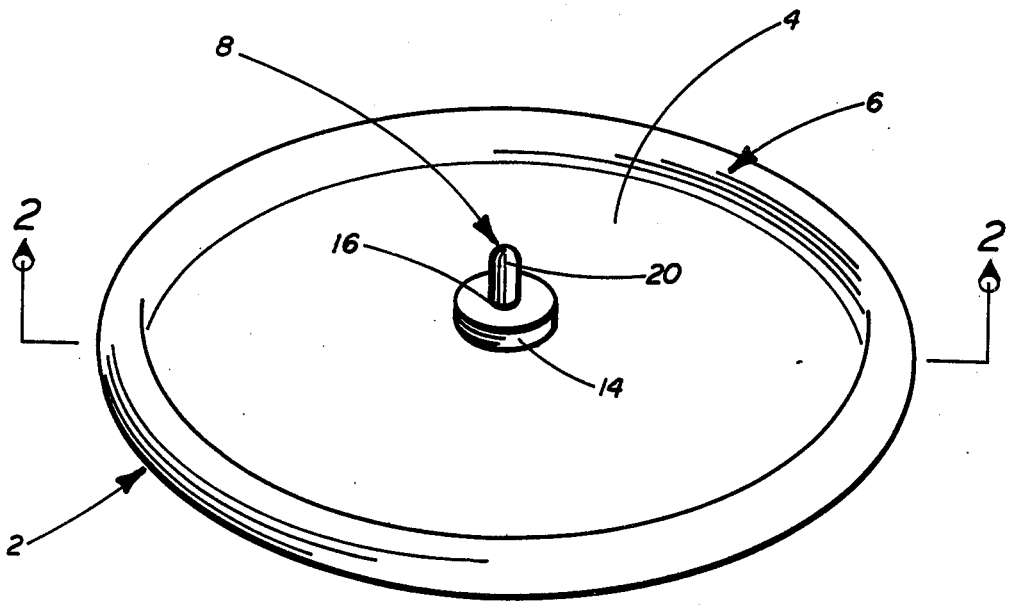
FIG. 1 is a perspective view of a proposed aerodynamic disc-shaped object of the present invention.

Referring to the drawings, wherein like numerals represent like parts, FIG. 1 represents an aerodynamic disc-shaped object 2 in accordance with the present invention, comprising a disc 4, an outer rim section 6 attached to the periphery of disc 4, and a central section 8 disposed within disc 4 at the center thereof, wherein central section 8 comprises a substantial amount of the weight of object 2 for increasing the rotational spin of the disc-shaped object.

Figure 2:
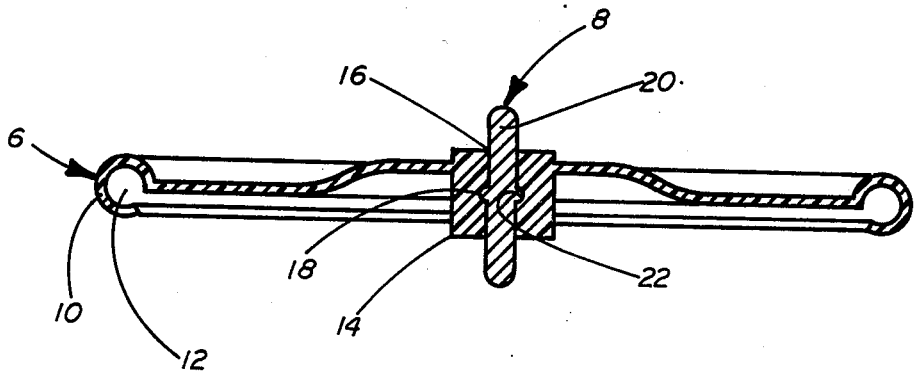
FIG. 2 is a cross-sectional view of the embodiment of FIG. 1 taken along line 2—2.
Figure 3:
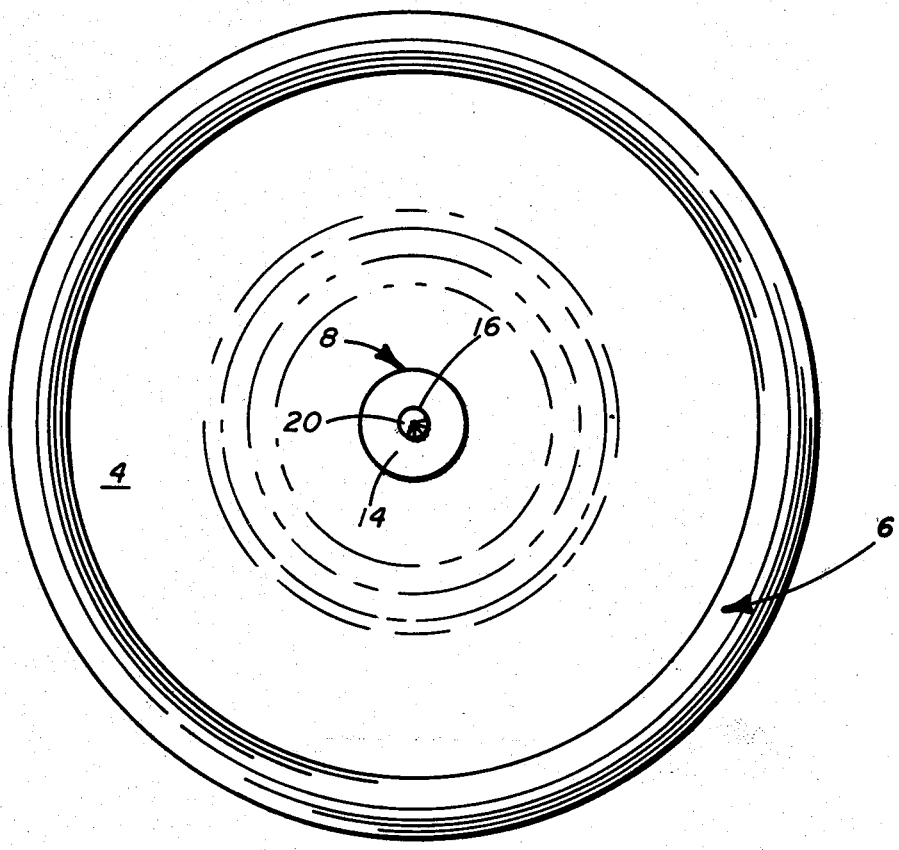
FIG. 3 is a top plan view of the embodiment of FIG. 1 of the present invention.

Referring to FIGS. 1 and 2, disc 4 is seen to possess a circular perimeter and a substantially planar or slightly curved cross-sectional configuration. Disc 4 may be made from any suitable material, but is preferably of a thin, flexible and durable plastic.

Attached to the periphery of disc 4 is an outer rim section 6, rim section 6 preferably being of a toroidal or donut-shaped configuration. As shown in FIG. 2, toroidal rim section 6 is partially open at any end cross-section 10. In this manner, an air pocket 12 is formed within toroidal rim section 6 to provide lift to object 2 when thrown. Additionally, the configuration of a toroidal rim section 6 adds some weight to rim 6, thus aiding in the stabilization of object 2, to be later discussed. However, it is to be noted that any suitable outer rim section 6 may be utilized in conjunction with the present invention, e.g., such as the rim section utilized in U.S. Pat. No. 3,359,678.

Referring to FIGS. 1 and 2, one embodiment of central section 8 of the present invention is disclosed. Central section 8 includes a central core 14 integrally attached near its upper end to disc 4 at the center thereof. As shown in FIG. 2, central core 14 includes a central bore 16 having a circular groove 18 therein.

Referring to FIG. 2, central section 8 comprises a central axis 20, axis 20 being preferably of a rod-like, cylindrical configuration and providing a substantial amount of the weight of object 2. Additionally, central axis 20 includes a circular detent 22 thereon corresponding to groove 18 of central bore 16. In this manner, central axis 20 may be removably secured within bore 16 of central core 14. Alternatively, central axis 20 may be secured within the bore 16 in any suitable manner such as press-fitting or the like. Referring to FIG. 2, central axis 20 extends from both ends of bore 16, thus providing added stability to object 2 during its trajectory. In its preferred embodiment, central axis 20 is of a magnetized metallic material and comprises 80 percent of the weight of object 2.

Alternatively, it is seen that any suitable central section 8 may be utilized wherein central section 8 comprises a substantial amount of the weight of object 2 for increasing the rotational spin of the disc-shaped object. For example, central core 14 may be molded as a continuous cylinder without bore 16 and of a denser material than disc 4. It is to be noted that disc-shaped object 2 is useful with a particular device for catching and throwing disc-shaped object 2 disclosed in co-pending Ser. No. 853,463 by Richard A. Sullivan et al.

It is thus seen that the combination of a substantial amount of the weight of object 2 at its center in conjunction with a toroidal rim section 6, in which the rim 6 provides some weight at the periphery of object 2 and forms air pockets therein, results in a disc-shaped object 2 having maximum rotational spin and stability. This result can be seen from the viewpoint of classical physics, e.g., when two discs of the same weight have equal energy imparted to them, the disc with the lower rotational inertia will have a greater angular spin. This latter result is due to the fact that the kinetic energy of an object is equivalent to one-half the rotational inertia times the square of the angular velocity. More particularly, since rotational inertia is equivalent to the sum of all mass points times the square of the radius of such points, if two discs have equivalent weight but varying displacement thereof, the disc having its weight closer to the center will have a lower rotational inertia and thus will spin faster than the other disc when the same energy is imparted to both discs. In this manner, a disc-shaped object 2 with its weight at the center will travel further than another disc of equivalent weight.

It is to be understood that the invention is not limited to the illustrations described and shown herein, which are deemed to be merely illustrative of the best modes of carrying out the invention, and which are suitable of modification of form, size, arrangement of parts, and details of operation. The invention rather is intended to encompass all such modifications which are within the spirit and scope as defined by the claims.

I claim:

1. An aerodynamic disc-shaped object, comprising:

a disc having periphery thereto;

an outer rim section attached to the periphery of said disc; and a central section disposed within the center of said disc, said central section comprising a central axis of rotation, said central section additionally comprising a substantial amount of the total weight of said disc-shaped object for increasing the rotational spin of said object.

2. The aerodynamic disc-shaped object of claim 1, wherein said disc is of a planar, cross-sectional configuration.

3. The aerodynamic disc-shaped object of claim 1, wherein said disc is of a slightly curved cross-sectional configuration.

4. The aerodynamic disc-shaped object of claim 1, wherein said outer rim section is of a toroidal configuration, said toroidal rim section being partially open at any end cross-section.

5. The aerodynamic disc-shaped object of claim 1, wherein said central axis comprises a majority of the weight of said object.

6. The aerodynamic disc-shaped object of claim 5, wherein said central axis comprises 80 percent of the weight of said object.

7. The aerodynamic disc-shaped object of claim 1, wherein said central axis is of a magnetic material.

* * * * *